US009653091B2

(12) United States Patent
Matsuo

(10) Patent No.: US 9,653,091 B2
(45) Date of Patent: May 16, 2017

(54) ECHO SUPPRESSION DEVICE AND ECHO SUPPRESSION METHOD

(71) Applicant: FUJITSU LIMITED, Kawasaki-shi, Kanagawa (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/741,777

(22) Filed: Jun. 17, 2015

(65) Prior Publication Data

US 2016/0035366 A1 Feb. 4, 2016

(30) Foreign Application Priority Data

Jul. 31, 2014 (JP) ..... 2014-157133

(51) Int. Cl.

*G10L 21/02* (2013.01)
*G10K 11/16* (2006.01)
*G10L 21/0208* (2013.01)

(52) U.S. Cl.

CPC ..... *G10L 21/02* (2013.01); *G10K 11/16* (2013.01); *G10L 21/0208* (2013.01); *G10L 2021/02082* (2013.01)

(58) Field of Classification Search

CPC ..... G10L 21/02; G10K 11/16
USPC ..... 381/56, 57, 66, 71.6, 71.11, 92, 94.1, 381/94.2, 94.3, 104; 700/94; 704/205, 704/227, 226; 324/307; 342/101, 174; 348/143; 379/406.01
See application file for complete search history.

(56) References Cited

U.S. PATENT DOCUMENTS 6,226,380 B1 5/2001 Ding
7,349,547 B1 * 3/2008 Isvan ..... H03G 3/001 379/430
7,672,445 B1 3/2010 Zhang et al.
8,433,074 B2 * 4/2013 Hoshuyama ..... H04M 9/082 379/406.01

(Continued)

FOREIGN PATENT DOCUMENTS

JP 2005-531956 10/2005
WO 97/23055 6/1997
WO 2007/083349 A1 7/2007

OTHER PUBLICATIONS

Extended European Search Report mailed Apr. 29, 2016 in related European Application No. 15174037.0.

(Continued)

*Primary Examiner* — Gerald Gauthier
(74) *Attorney, Agent, or Firm* — Staas & Halsey LLP

(57) ABSTRACT

An echo suppression device includes a processor; and a memory which stores a plurality of instructions, which when executed by the processor, cause the processor to execute: generating a corrected sound signal by suppressing an echo signal representing an echo generated by collecting, by a sound input unit, a sound arising from a reproduction sound signal reproduced by a sound output unit; obtaining a gain to attenuate the corrected sound signal according to a degree of distortion of the echo signal with which intensity of the echo signal non-linearly changes with respect to an intensity change of the reproduction sound signal; and suppressing the corrected sound signal according to the gain.

15 Claims, 11 Drawing Sheets

(56) References Cited

U.S. PATENT DOCUMENTS

2005/0278172 A1* 12/2005 Koishida ..... G10L 21/0208 704/227
2006/0034355 A1 2/2006 Auvray et al.
2007/0076899 A1* 4/2007 Hsu ..... H04R 3/005 381/92
2009/0041263 A1* 2/2009 Hoshuyama ..... H04B 3/32 381/94.1
2009/0154717 A1* 6/2009 Hoshuyama ..... H04R 3/02 381/66
2009/0168993 A1 7/2009 Yano et al.
2009/0175463 A1* 7/2009 Lee ..... H04R 3/005 381/71.6
2010/0228368 A1* 9/2010 Oh ..... H04R 3/04 700/94
2012/0002819 A1* 1/2012 Thormundsson ..... H03F 1/26 381/71.11
2012/0116755 A1* 5/2012 Park ..... G10L 21/02 704/205
2012/0155657 A1* 6/2012 Takao ..... H04N 7/142 381/57
2013/0223645 A1* 8/2013 Hetherington ..... H04R 3/002 381/94.3
2014/0211954 A1* 7/2014 Hetherington ..... H04R 3/02 381/57
2014/0376742 A1* 12/2014 Hetherington ..... H04R 3/005 381/94.2
2015/0036832 A1* 2/2015 Usher ..... H04R 3/005 381/56
2016/0035366 A1* 2/2016 Matsuo ..... G10L 21/02 381/66
2016/0066089 A1* 3/2016 Klein ..... G10L 21/0208 381/94.2

OTHER PUBLICATIONS

Partial European Search Report mailed Jan. 12, 2016 in related European Application No. 15174037.0.

* cited by examiner

ECHO SUPPRESSION DEVICE AND ECHO SUPPRESSION METHOD

CROSS-REFERENCE TO RELATED APPLICATION

This application is based upon and claims the benefit of priority from the prior Japanese Patent Application No. 2014-157133 filed on Jul. 31, 2014, the entire contents of which are incorporated herein by reference.

FIELD

The embodiments discussed herein are related to, for example, an echo suppression device, an echo suppression method, and a non-transitory computer-readable medium.

BACKGROUND

A sound emitted from a speaker possessed by a device to and from which sounds may be input and output is often input as an echo from a microphone possessed by the device. Possibly such an echo lowers the quality of an input sound signal and makes it difficult to hear a sound as a collection target. Therefore, techniques to suppress echoes have been proposed.

For example, an echo cancelling device disclosed in International Publication Pamphlet No. WO 2007/083349 includes an adaptive filter that subtracts a pseudo echo signal generated from a reception signal from a transmission signal to carry out echo cancelling and a variable attenuator that adds a loss to a residual signal resulting from the echo cancelling by the adaptive filter. Moreover, this echo cancelling device includes an attenuator controller that controls the amount of loss of the variable attenuator on the basis of the result of a determination as to whether or not the state is a double-talk state.

Furthermore, an echo processing device disclosed in Japanese National Publication of International Patent Application No. 2005-531956 applies an in-reception gain to a direct signal to generate an input signal transmitted in an echo generation system, and applies an in-transmission gain to an output signal emitted from the echo generation system to generate a return signal. Furthermore, this echo processing device calculates the in-reception gain and the in-transmission gain on the basis of a coupling variable that forms a characteristic of acoustic coupling existing between the direct signal or the input signal and the output signal.

SUMMARY

In accordance with an aspect of the embodiments, an echo suppression device includes a processor; and a memory which stores a plurality of instructions, which when executed by the processor, cause the processor to execute: generating a corrected sound signal by suppressing an echo signal representing an echo generated by collecting, by a sound input unit, a sound arising from a reproduction sound signal reproduced by a sound output unit; obtaining a gain to attenuate the corrected sound signal according to a degree of distortion of the echo signal with which intensity of the echo signal non-linearly changes with respect to an intensity change of the reproduction sound signal; and suppressing the corrected sound signal according to the gain.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which.

DESCRIPTION OF EMBODIMENTS

An echo suppression device will be described below with reference to the drawings. First, a description will be made about distortion of a sound signal generated by a microphone, attributed to a device relating to input and output of sounds, such as a speaker or the microphone.

Figure 1:
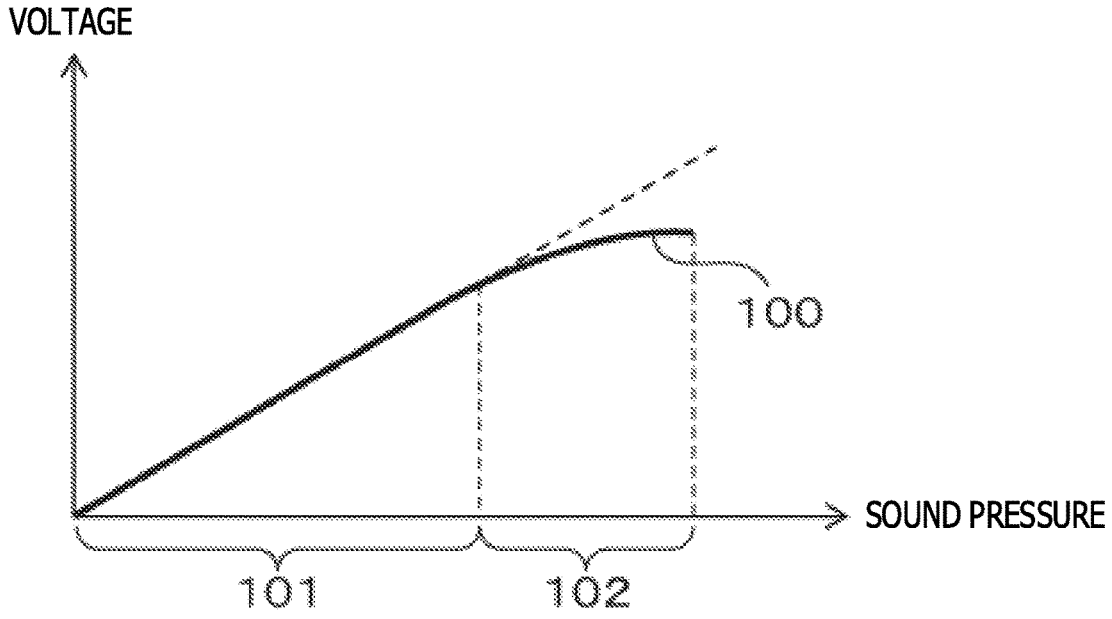
FIG. 1 is a diagram illustrating one example of a relationship between a sound pressure of a sound collected by a microphone and a voltage of a sound signal generated by a microphone.

FIG. 1 is a diagram illustrating one example of a relationship between a sound pressure of a sound collected by a microphone and a voltage of a sound signal generated by a microphone. In FIG. 1, the abscissa axis represents the sound pressure and the ordinate axis represents the voltage. Furthermore, a graph 100 represents the relationship between the sound pressure and the voltage of the sound signal. As illustrated in the graph 100, when the sound pressure is included in a comparatively-low range 101, the voltage of the sound signal also rises linearly in association with the rise of the sound pressure. On the other hand, when the sound pressure is included in a comparatively-high range 102, the rise of the voltage of the sound signal becomes gentler as the sound pressure rises to a higher level due to e.g. restrictions on the operating range of a vibrating plate that is possessed by the microphone and is to convert the sound pressure to the voltage. Then, the voltage is saturated at a certain value when the sound pressure is a certain sound pressure or higher. Therefore, in the range 102, the relationship of the intensity change of the voltage of the output sound signal with respect to the change in the sound pressure is non-linear. Similarly, also regarding the speaker and an amplifier coupled to the microphone or the speaker, the relationship of the intensity change of an output signal is non-linear with respect to the intensity change of an input signal in some cases. Therefore, distortion with which the intensity change of an input sound signal that is obtained by collecting, by the microphone, a sound arising from reproduction of a reproduction sound signal by the speaker and represents an echo is non-linear with respect to the intensity change of the reproduction sound signal is caused in the input sound signal in some cases. Hereinafter, such distortion will be referred to as non-linear distortion for the sake of convenience.

Therefore, the echo suppression device obtains a gain depending on the non-linear distortion caused in the input sound signal from the reproduction sound signal and the input sound signal, which is obtained by collecting, by the microphone, a sound arising from reproduction of the reproduction sound signal by the speaker and represents an echo. Then, the echo suppression device suppresses the input sound signal according to the gain. Thereby, the echo suppression device sufficiently suppresses the echo even when the non-linear distortion attributed to the device relating to input and output of sounds is caused in the input sound signal.

Figure 2:
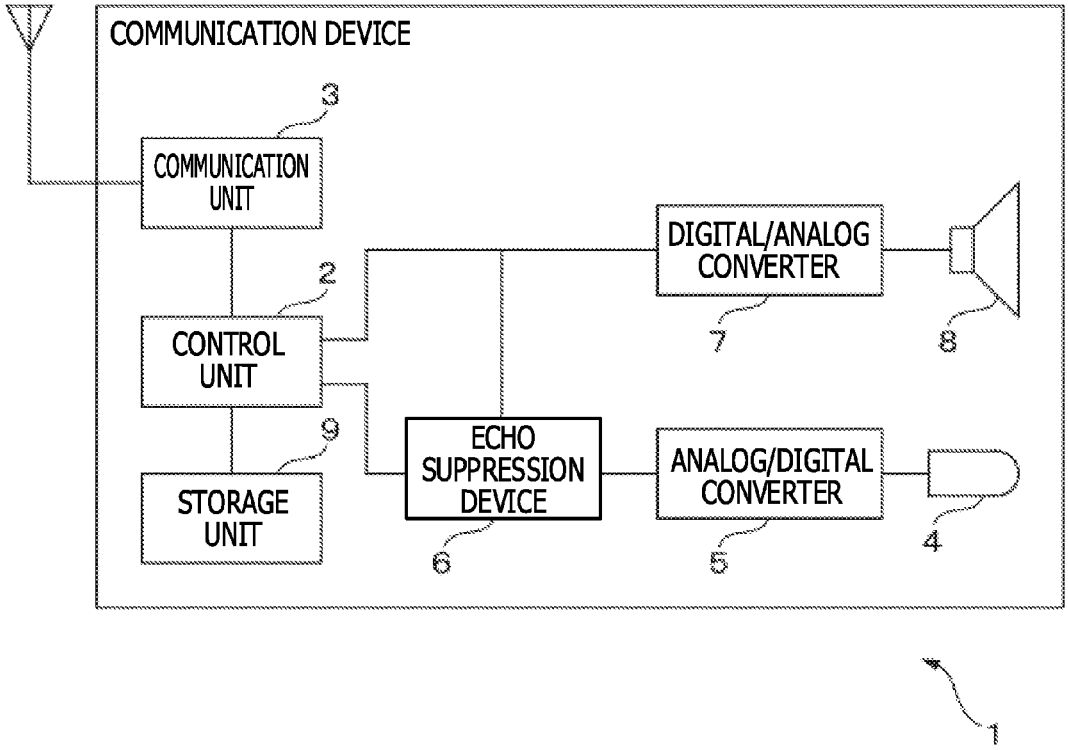
FIG. 2 is a schematic configuration diagram of a communication device in which an echo suppression device according to a first embodiment is implemented.

FIG. 2 is a schematic configuration diagram of a communication device in which an echo suppression device according to a first embodiment is implemented. A communication device 1 is e.g. an in-vehicle hands-free phone or a mobile phone. As illustrated in FIG. 2, the communication device 1 includes a control unit 2, a communication unit 3, a microphone 4, an analog/digital converter 5, an echo suppression device 6, a digital/analog converter 7, a speaker 8, and a storage unit 9.

Among these units, the control unit 2, the communication unit 3, and the echo suppression device 6 are each formed as a separate circuit. Alternatively, these respective units may be implemented in the communication device 1 as one integrated circuit into which circuits corresponding to the respective units are integrated. Moreover, these respective units may be functional modules implemented by a computer program executed on a processor possessed by the communication device 1.

The control unit 2 includes at least one processor, a non-volatile memory, a volatile memory, and a peripheral circuit thereof. When a phone call is started by operation through an operation unit (not illustrated) such as keypads, the control unit 2 executes call control processing of wireless connection, disconnection, and so forth between the communication device 1 and another communication device (not illustrated) such as a base station in accordance with a communication standard with which the communication device 1 complies. Then, the control unit 2 instructs the communication unit 3 to start or end the voice phone call according to the result of the call control processing. Moreover, the control unit 2 extracts a coded sound signal or an audio signal included in a signal received from the other communication device via the communication unit 3 and decodes the sound signal or the audio signal. Then, the control unit 2 outputs the decoded sound signal or audio signal to the echo suppression device 6 and the digital/analog converter 7 as a reproduction sound signal.

Furthermore, the control unit 2 codes an input sound signal input via the microphone 4 and generates a transmission signal including the coded input sound signal. Then, the control unit 2 transfers the transmission signal to the communication unit 3. As the coding system for the sound signal, the adaptive multi-rate-narrowband (AMR-NB) system or the adaptive multi-rate-wideband (AMR-WB) system standardized by the third generation partnership project (3GPP), or the like is used for example.

Alternatively, according to operation by a user through the operation unit, the control unit 2 may read out a coded audio signal stored in the storage unit 9 and decode the audio signal. Then, the control unit 2 may output the decoded audio signal to the echo suppression device 6 as a reproduction sound signal. In this case, as the coding system for the audio signal, the moving picture experts group-4 advanced audio coding (MPEG-4 MC) or high-efficiency MC (HE-AAC) system, the standard of which is established in the MPEG, or the like is used for example.

The communication unit 3 carries out wireless communications with another communication device. Furthermore, the communication unit 3 receives a wireless signal from the other communication device and converts the wireless signal to a reception signal having a baseband frequency. Then, the communication unit 3 executes reception processing of demultiplexing, demodulation, and so forth for the reception signal and thereafter transfers the reception signal to the control unit 2. Furthermore, the communication unit 3 executes transmission processing of modulation, multiplexing, and so forth for a transmission signal received from the control unit 2 and thereafter superimposes the transmission signal on a carrier wave having a wireless frequency to transmit the transmission signal to the other communication device.

The microphone 4 is one example of a sound input unit. The microphone 4 collects sounds around the communication device 1 and generates an analog input sound signal according to the sound pressure of the sounds. In the sounds collected by the microphone 4, for example, not only sounds that reach the microphone 4 from a sound source as a sound collection target, such as the mouth of a user, but also a reproduced sound that is output from the speaker 8 and becomes an echo is often included. Then, the microphone 4 outputs the analog input sound signal to the analog/digital converter 5.

The analog/digital converter 5 generates a digitized input sound signal by sampling the analog input sound signal received from the microphone 4 at a given sampling pitch. Furthermore, the analog/digital converter 5 may include an amplifier and perform digitization after amplifying the analog input sound signal.

The analog/digital converter 5 outputs the digitized input sound signal to the echo suppression device 6. Hereinafter, the digitized input sound signal will be referred to simply as the input sound signal.

The echo suppression device 6 generates a corrected sound signal by suppressing the input sound signal representing an echo. Then, the echo suppression device 6 outputs the corrected sound signal to the control unit 2. Details of the echo suppression device 6 will be described later.

The digital/analog converter 7 performs digital-analog conversion on a reproduction sound signal received from the control unit 2 to turn the reproduction sound signal to an analog signal. The digital/analog converter 7 may include an amplifier and amplify the reproduction sound signal turned to the analog signal by the amplifier. Then, the digital/analog converter 7 outputs the reproduction sound signal turned to the analog signal to the speaker 8.

The speaker 8 is one example of a sound output unit and reproduces the reproduction sound signal that is received from the digital/analog converter 7 and is turned to the analog signal.

The storage unit 9 includes e.g. a non-volatile semiconductor memory and stores various data used in the communication device 1, e.g. personal information of a user, history information of mail, telephone numbers, audio signals, and video signals.

Details of an echo suppression device will be described below.

Figure 3:
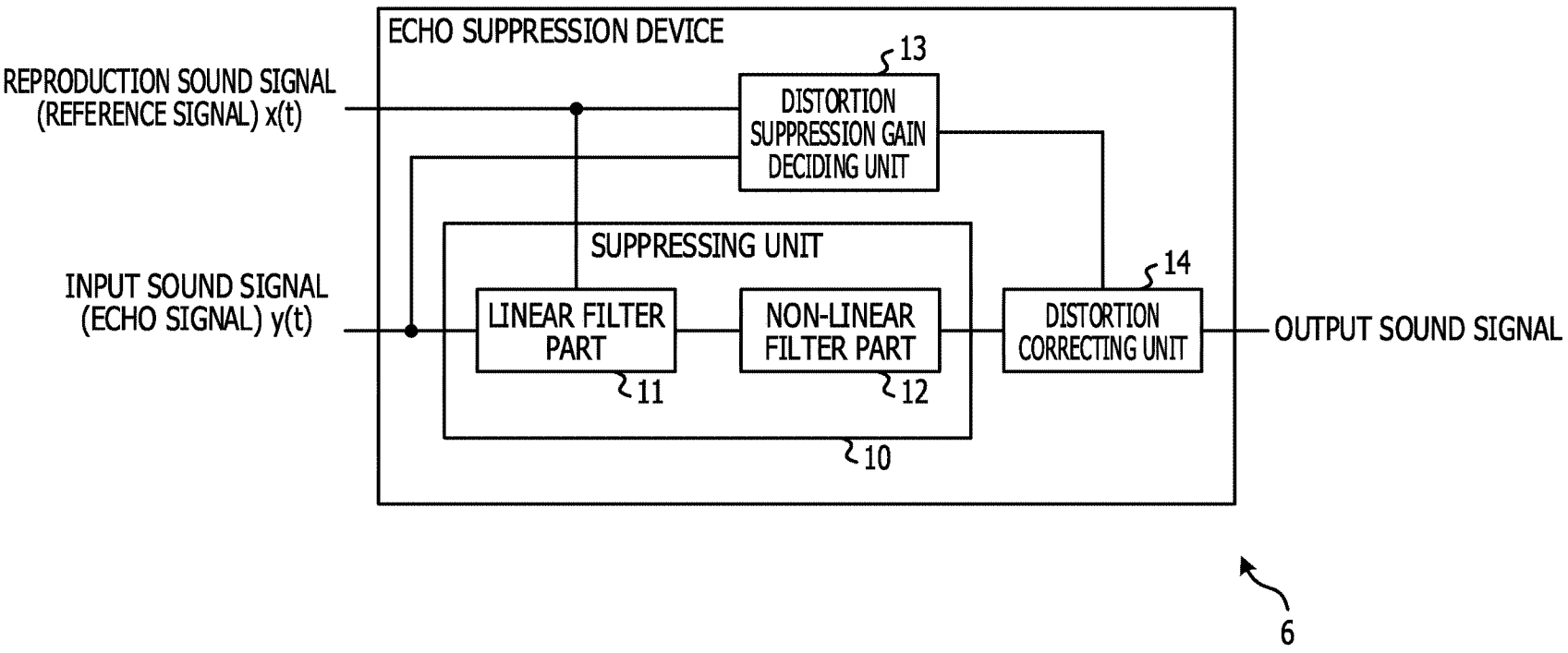
FIG. 3 is a schematic configuration diagram of an echo suppression device according to the first embodiment.

FIG. 3 is a schematic configuration diagram of an echo suppression device according to the first embodiment. The echo suppression device in FIG. 3 may be the echo suppression device 6 depicted in FIG. 2. The echo suppression device 6 includes a suppressing unit 10, a distortion suppression gain deciding unit 13, and a distortion correcting unit 14.

These respective units possessed by the echo suppression device 6 may be each implemented in the echo suppression device 6 as a separate circuit or may be one integrated circuit that implements the functions of these respective units.

The input sound signal obtained through reproduction of the reproduction sound signal output from the control unit 2 to the speaker 8 by the speaker 8 and sound collection by the microphone 4 represents an echo corresponding to the reproduction sound signal.

Therefore, hereinafter, the reproduction sound signal output from the control unit 2 to the speaker 8 will be referred to as the reference signal for the sake of convenience. Furthermore, the input sound signal obtained by collecting, by the microphone 4, a sound arising from the reproduction of the reproduction sound signal by the speaker 8 will be referred to as the echo signal.

The suppressing unit 10 suppresses the echo signal. For this purpose, the suppressing unit 10 includes a linear filter part 11 and a non-linear filter part 12.

The linear filter part 11 suppresses the echo signal by using a linear filter. In the present embodiment, the linear filter part 11 uses, as the linear filter, an N-th-order (N is an integer equal to or larger than 1 and is set to e.g. 16 to 128) finite impulse response (FIR) adaptive filter. In this case, linear filter processing by the adaptive filter is represented by the following expression.

$$e(t)=y(t)-\Sigma_{i=0}^{N-1}a_i x(t-i) \tag{1}$$

In the expression, x(t) is the reference signal at a time t and y(t) is the echo signal at the time t. Furthermore, $a_i$ (i=0, 1, . . . , N−1) is a filter coefficient of the adaptive filter. In addition, e(t) is a residual echo signal representing a residual component of the echo signal at the time t.

Furthermore, the linear filter part 11 learns the adaptive filter on the basis of the reference signal and the echo signal. The coefficient of the adaptive filter is updated in accordance with the following expression for example.

$$a_i' = a_i + b \cdot e(t) \frac{x(t-i)}{\sum_{j=0}^{N-1} x^2(t-j)} \tag{2}$$

In the expression, $a_i'$ (i=0, 1, . . . , N−1) is a filter coefficient after the update. Furthermore, b is a convergence coefficient for deciding the update rate of the adaptive filter and is set to a value that is larger than 0.0 and smaller than 1 for example.

The linear filter part 11 outputs the residual echo signal to the non-linear filter part 12.

The non-linear filter part 12 suppresses the residual echo signal by non-linear filter processing. In the present embodiment, the non-linear filter part 12 calculates the power of the residual echo signal and suppresses the residual echo signal if the power is lower than a given power threshold.

For example, in accordance with the following expression, the non-linear filter part 12 calculates the average of the power of the residual echo signal at each time included in a frame whose end is at the present time t as power Pe(t) of the residual echo signal at the present time t.

$$Pe(t)=10\ \log_{10}(\Sigma_{j=0}^{N-1}e(t-j)^2/N) \tag{3}$$

In the expression, N is an integer equal to or larger than 1 and represents the frame length. N is set to 16 to 1024 for example.

If the power Pe(t) is equal to or higher than a power threshold ThP, it is estimated that a sound other than the echo component or a component of a sound around the microphone 4 is included in the residual echo signal e(t). Therefore in this case, the non-linear filter part 12 does not suppress the residual echo signal e(t). That is, the non-linear filter part 12 sets a gain g(t) by which the residual echo signal e(t) is multiplied to 1.0. The power threshold ThP is set to the value obtained by subtracting 50 dB from the maximum value that may be taken by the power Pe(t) (hereinafter, referred to as the full scale) for example.

On the other hand, if the power Pe(t) is lower than the power threshold ThP, it is estimated that only an echo component is included in the residual echo signal e(t). Therefore, in this case, the non-linear filter part 12 calculates the gain g(t) in accordance with the following expression so that the residual echo signal e(t) may become the value obtained by subtracting 60 dB from the full scale of Pe(t).

$$g(t) = \frac{0.001}{\sqrt{\sum_{j=0}^{N-1} e(t-j)^2 / N}} \tag{4}$$

The non-linear filter part 12 multiplies the residual echo signal e(t) by the gain g(t) to calculate a corrected residual echo signal. Then, the non-linear filter part 12 outputs the corrected residual echo signal to the distortion correcting unit 14. The corrected residual echo signal is one example of the corrected sound signal.

The distortion suppression gain deciding unit 13 obtains a gain to attenuate the corrected residual echo signal according to the degree of echo signal distortion with which the intensity of the echo signal non-linearly changes with respect to the intensity change of the reproduction sound signal.

As described regarding FIG. 1, due to the characteristics of the device relating to input and output of sounds, such as the microphone 4, non-linear distortion is caused in the echo signal when the reference signal is large. Furthermore, when the non-linear distortion is caused in the echo signal, the difference between the waveform of the echo signal and the waveform of the reference signal becomes large.

Therefore, in the present embodiment, the distortion suppression gain deciding unit 13 uses the power of the reference signal and the absolute value of the cross-correlation value between the reference signal and the echo signal as indices representing the non-linear distortion caused in the echo signal.

For example, in accordance with the following expression, the distortion suppression gain deciding unit 13 calculates the average of the power of the reference signal x(t) at each time included in a frame whose end is at the present time t as power Px(t) of the reference signal x(t) at the present time t.

$$Px(t)=10\log_{10}(\Sigma_{j=0}^{N-1}x(t-j)^2/N) \quad (5)$$

In the expression, N is an integer equal to or larger than 1 and represents the frame length. N is set to 16 to 1024 for example.

Furthermore, the distortion suppression gain deciding unit 13 calculates a cross-correlation value C(t) between the reference signal and the echo signal in accordance with the following expression.

$$C(t)=\frac{\sum_{j=0}^{N-1}x(t-j)y(t-j)}{\sum_{j=0}^{N-1}x(t-j)^2\sum_{j=0}^{N-1}y(t-j)^2} \quad (6)$$

On the basis of the power Px(t) of the reference signal, the distortion suppression gain deciding unit 13 sets an upper-limit threshold β of the absolute value |C(t)| of the cross-correlation value under which the gain g(t) is set to a value smaller than 1.

Figure 4:
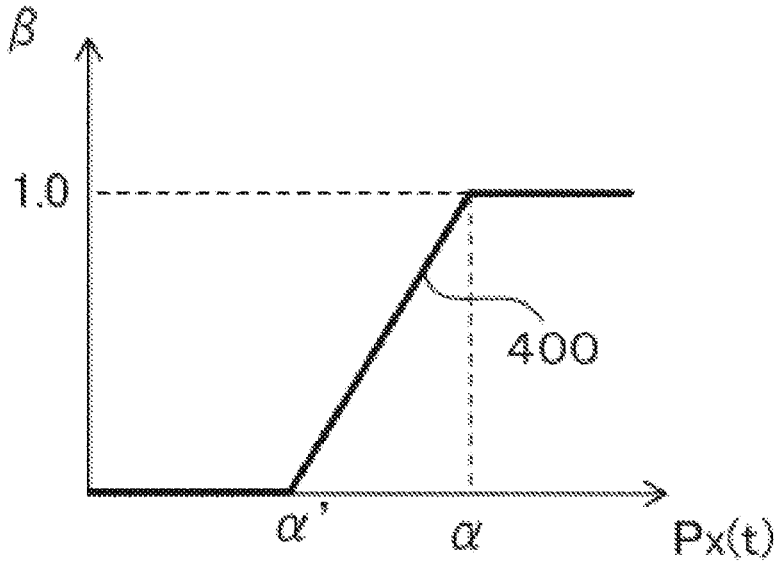
FIG. 4 is a diagram illustrating a relationship between power of a reference signal and a threshold.

FIG. 4 is a diagram illustrating the relationship between the power Px(t) of the reference signal and the threshold β of the absolute value |C(t)| of the cross-correlation value under which the gain g(t) is set to a value smaller than 1. In FIG. 4, the abscissa axis represents the power Px(t) and the ordinate axis represents the threshold β. Furthermore, a graph 400 represents the relationship between the power Px(t) and the threshold β. As illustrated in the graph 400, when the power Px(t) is equal to or higher than a given value α, the threshold β is set to 1.0. On the other hand, when the power Px(t) is lower than a given value α', the threshold β is set to 0.0. Furthermore, when the power Px(t) is equal to or higher than the given value α' and is lower than α, the threshold β also monotonically increases linearly as the power Px(t) becomes higher. The given value α is set to the value obtained by subtracting 6 dB from the full scale of the power Px(t) for example. Furthermore, the given value α' is set to the value obtained by subtracting 12 dB from the full scale of the power Px(t) for example.

Figure 5:
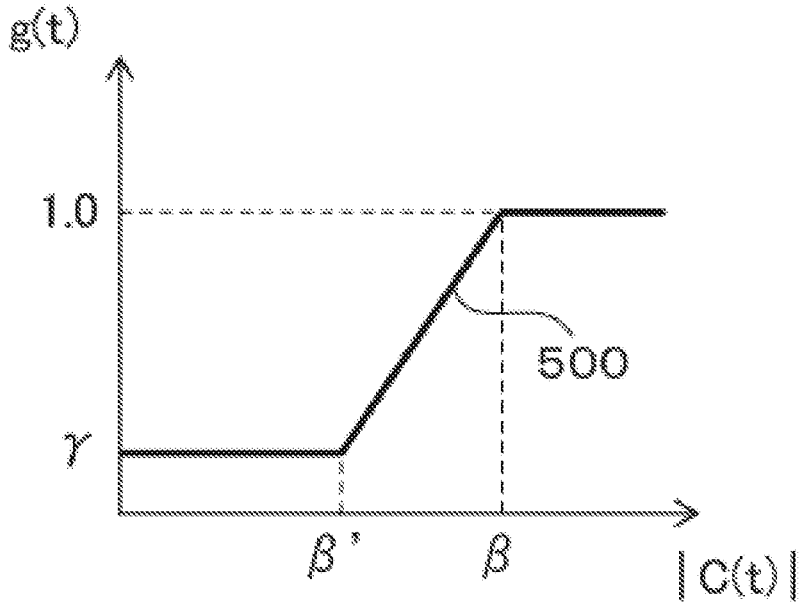
FIG. 5 is a diagram illustrating a relationship between an absolute value of a cross-correlation value and a gain.

FIG. 5 is a diagram illustrating the relationship between the absolute value |C(t)| of the cross-correlation value and the gain g(t). In FIG. 5, the abscissa axis represents the absolute value |C(t)| of the cross-correlation value and the ordinate axis represents the gain g(t). Furthermore, a graph 500 represents the relationship between the absolute value |C(t)| of the cross-correlation value and the gain g(t). As illustrated in the graph 500, when the absolute value |C(t)| of the cross-correlation value is equal to or larger than the upper-limit threshold β, the gain g(t) is set to 1.0. That is, the corrected residual echo signal is not suppressed. On the other hand, when the absolute value |C(t)| of the cross-correlation value is smaller than a lower-limit threshold β', the gain g(t) is set to a lower-limit value γ thereof. Furthermore, when the absolute value |C(t)| of the cross-correlation value is equal to or larger than the lower-limit threshold β' and is smaller than the upper-limit threshold β, the gain g(t) also monotonically increases linearly as the absolute value |C(t)| of the cross-correlation value becomes larger. The lower-limit threshold β' is set to β/2 for example. Furthermore, the lower-limit value γ of the gain g(t) is set to 0.01 to 0.1 for example.

As illustrated in FIGS. 4 and 5, the threshold β is larger when the power of the reference signal x(t) is higher, and therefore the gain g(t) is lower when the power of the reference signal x(t) is higher and the absolute value |C(t)| of the cross-correlation value is smaller.

A table or expression representing the relationship between the power Px(t) and the threshold β illustrated in the graph 400 is stored in advance in a memory possessed by the distortion suppression gain deciding unit 13 for example. Furthermore, parameters representing the relationship between the threshold β and the absolute value |C(t)| of the cross-correlation value are also stored in advance in the memory possessed by the distortion suppression gain deciding unit 13. Then, the distortion suppression gain deciding unit 13 decides the threshold β corresponding to the power Px(t) with reference to the table or expression. Moreover, on the basis of the decided threshold β and the absolute value |C(t)| of the cross-correlation value, the distortion suppression gain deciding unit 13 decides the gain g(t) in accordance with the parameters representing the relationship illustrated in the graph 500.

According to a modification example, the distortion suppression gain deciding unit 13 may decide a lower-limit threshold of the power Px(t) over which the gain g(t) is set lower than 1 in such a manner that the lower-limit threshold is smaller when the absolute value |C(t)| of the cross-correlation value is smaller. Then, the distortion suppression gain deciding unit 13 may decide the gain g(t) in such a manner that the gain g(t) is lower when the power Px(t) is higher than the decided threshold and the difference between the power Px(t) and the threshold is larger.

The distortion suppression gain deciding unit 13 outputs the gain g(t) to the distortion correcting unit 14.

The distortion correcting unit 14 obtains an output sound signal by multiplying the corrected residual echo signal by the gain g(t) received from the distortion suppression gain deciding unit 13. Thereby, the echo signal is sufficiently suppressed even when the non-linear distortion is caused in the echo signal. Therefore, the echo suppression device 6 may satisfy a condition that an echo signal at a very high level is suppressed by 50 dB or higher as one of conditions about echo suppression prescribed by the standard, for example GOST-R.

Figure 6:
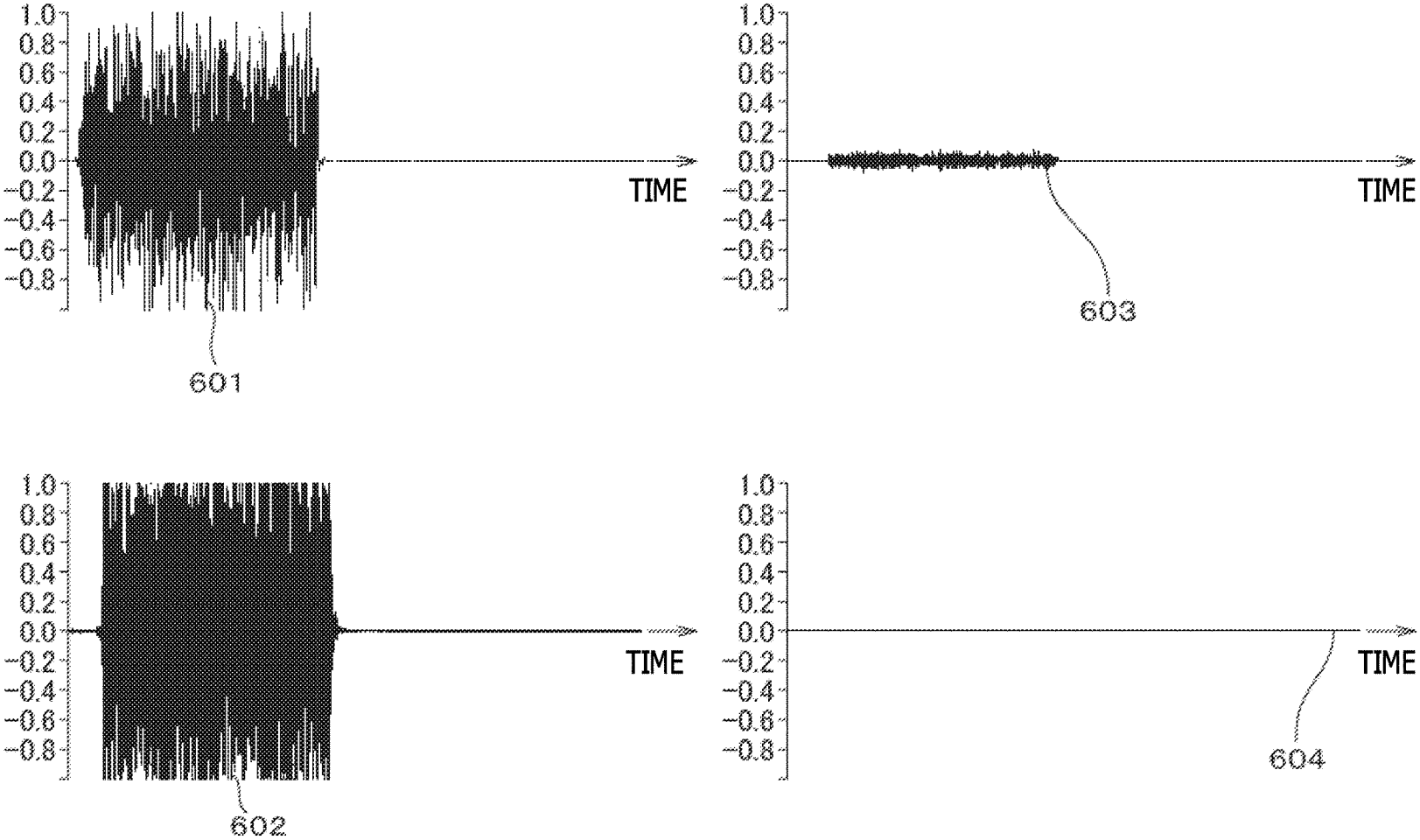
FIG. 6 is a diagram illustrating a suppression result of an echo signal when a distortion suppression gain deciding unit and a distortion correcting unit are not used and a suppression result of an echo signal when a distortion suppression gain deciding unit and a distortion correcting unit are used.

FIG. 6 is a diagram illustrating a suppression result of an echo signal when a distortion suppression gain deciding unit and a distortion correcting unit are not used and a suppression result of an echo signal when a distortion suppression gain deciding unit and a distortion correcting unit are used. The distortion suppression gain deciding unit and the distortion correcting unit described with reference to FIG. 6 may be the distortion suppression gain deciding unit 13 and the distortion correcting unit 14 depicted in FIG. 3, respectively. In each graph illustrated in FIG. 6, the abscissa axis represents the time and the ordinate axis represents the amplitude of the sound signal. A graph 601 represents a reference signal and a graph 602 represents the echo signal. A graph 603 represents an output sound signal when the distortion suppression gain deciding unit 13 and the distortion correcting unit 14 are not used. Furthermore, a graph 604 represents an output sound signal when the distortion suppression gain deciding unit 13 and the distortion correcting unit 14 are used.

As illustrated in the graph 603, it turns out that the echo is not sufficiently suppressed in the output sound signal and the amplitude of the output sound signal keeps a certain level of magnitude when the distortion suppression gain deciding unit 13 and the distortion correcting unit 14 are not used. In contrast, as illustrated in the graph 604, it turns out that the amplitude of the output sound signal is almost 0 and the echo is sufficiently suppressed when the distortion suppression gain deciding unit 13 and the distortion correcting unit 14 are used.

Figure 7:
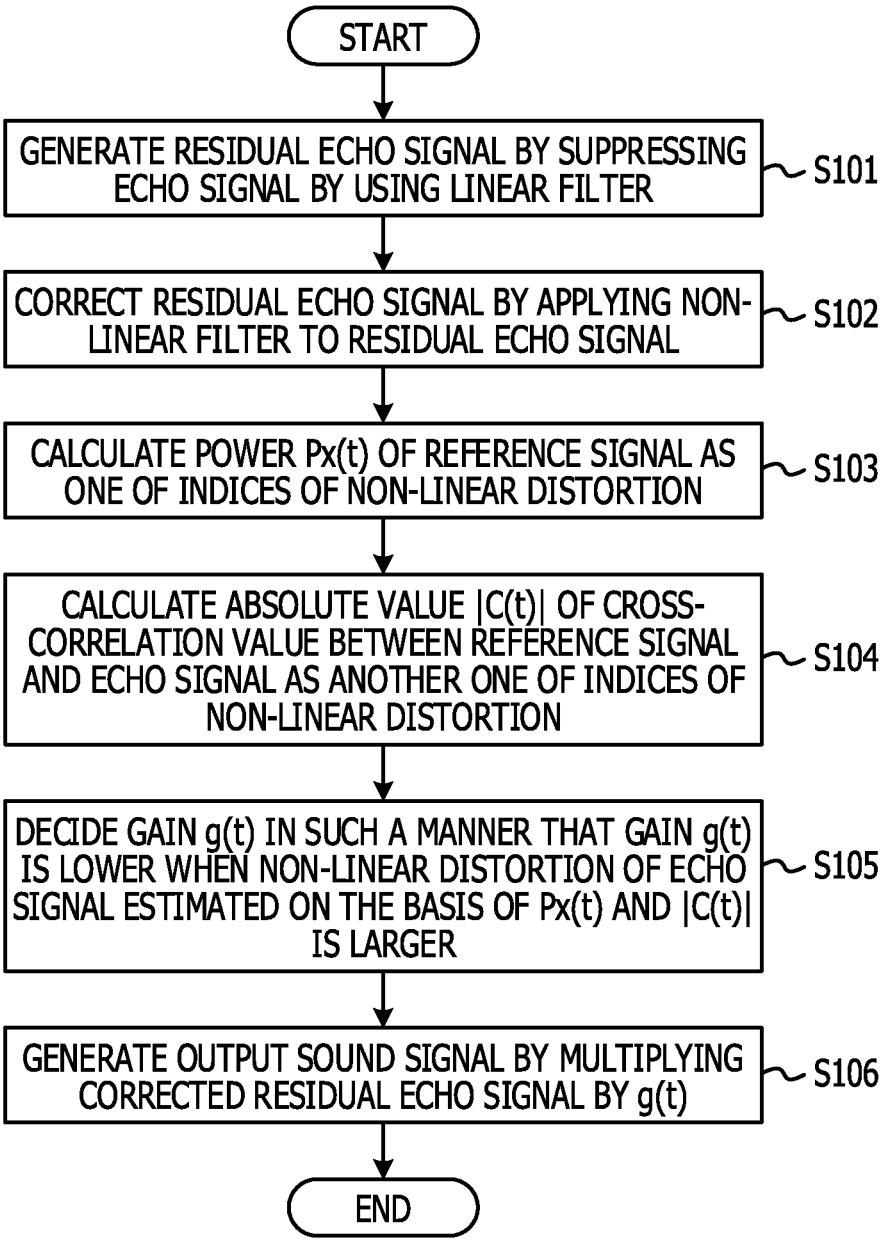
FIG. 7 is a flowchart of operation in echo suppression processing.

FIG. 7 is a flowchart of operation in echo suppression processing executed by an echo suppression device. The echo suppression device described with reference to FIG. 7 may be the echo suppression device 6 depicted in FIG. 2.

The linear filter part 11 suppresses an echo signal by using a linear filter to generate a residual echo signal (step S101). The non-linear filter part 12 corrects the residual echo signal in such a manner as to further suppress the residual echo signal by applying a non-linear filter to the residual echo signal (step S102).

Furthermore, the distortion suppression gain deciding unit 13 calculates the power Px(t) of the reference signal as one of indices representing non-linear distortion of the echo signal (step S103). Moreover, the distortion suppression gain deciding unit 13 calculates the absolute value |C(t)| of the cross-correlation value between a reference signal and the echo signal as another one of the indices representing the non-linear distortion of the echo signal (step S104). Then, the distortion suppression gain deciding unit 13 sets the gain g(t) in such a manner that the gain g(t) is lower when the non-linear distortion of the echo signal estimated on the basis of the power Px(t) of the reference signal and the absolute value |C(t)| of the cross-correlation value is larger (step S105).

The distortion correcting unit 14 multiplies a corrected residual echo signal by the gain g(t) to further suppress the echo component remaining in the corrected residual echo signal and make an output sound signal (step S106). Then, the distortion correcting unit 14 outputs the output sound signal to the control unit 2.

As described above, the echo suppression device 6 obtains each of the power of the reference signal and the absolute value of the cross-correlation value between the reference signal and the echo signal as the index representing the non-linear distortion of the echo signal. Furthermore, the echo suppression device 6 suppresses the echo signal to a larger extent when the non-linear distortion of the echo signal estimated on the basis of the power of the reference signal and the absolute value of the cross-correlation value between the reference signal and the echo signal is larger. Therefore, the echo suppression device 6 may sufficiently suppress the echo signal even when the non-linear distortion is caused in the echo signal.

Next, an echo suppression device according to a second embodiment will be described. The echo suppression device according to the second embodiment utilizes echo signals collected by using plural microphones different from each other in the placement position.

Figure 8:
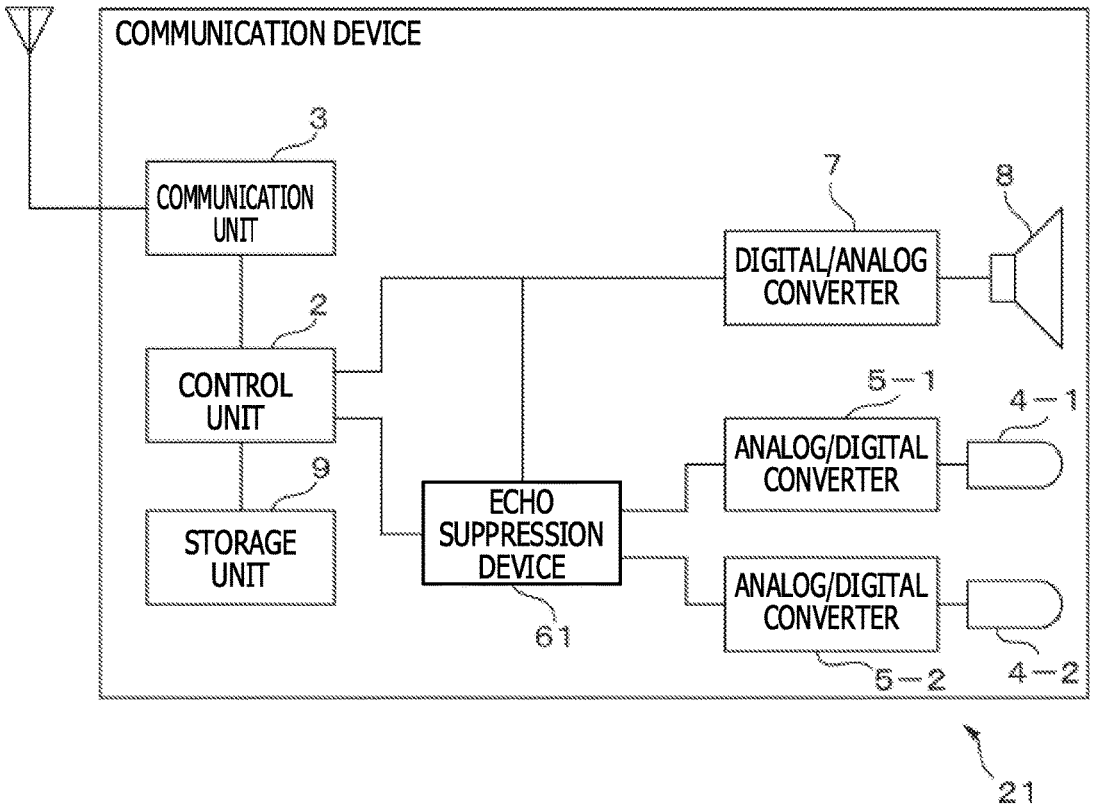
FIG. 8 is a schematic configuration diagram of a communication device in which an echo suppression device according to a second embodiment is implemented.

FIG. 8 is a schematic configuration diagram of a communication device in which an echo suppression device according to a second embodiment is implemented. A communication device 21 includes the control unit 2, the communication unit 3, two microphones 4-1 and 4-2, two analog/digital converters 5-1 and 5-2, an echo suppression device 61, the digital/analog converter 7, the speaker 8, and the storage unit 9.

When the communication device 21 according to the second embodiment is compared with the communication device 1 according to the first embodiment, the numbers of microphones and analog/digital converters and processing executed by the echo suppression device 61 are different. Therefore, in the following, the microphones 4-1 and 4-2, the analog/digital converters 5-1 and 5-2, and the echo suppression device 61 will be described. Regarding the other constituent elements in the communication device 21, refer to the description of the corresponding constituent elements in the communication device 1.

The microphones 4-1 and 4-2 are each one example of the sound input unit and are disposed at positions different from each other. Furthermore, an analog input sound signal generated through collection of an ambient sound by the microphone 4-1 is input to the analog/digital converter 5-1. Similarly, an analog input sound signal generated through collection of an ambient sound by the microphone 4-2 is input to the analog/digital converter 5-2.

The analog/digital converter 5-1 generates a digitized input sound signal by sampling the analog input sound signal received from the microphone 4-1 at a given sampling pitch. Similarly, the analog/digital converter 5-2 generates a digitized input sound signal by sampling the analog input sound signal received from the microphone 4-2 at a given sampling pitch.

Hereinafter, for convenience of description, the input sound signal that is generated by collecting, by the microphone 4-1, a sound arising from a reproduction sound signal reproduced by the speaker 8 and is digitized by the analog/digital converter 5-1 will be referred to as a first echo signal. Furthermore, the input sound signal that is generated by collecting, by the microphone 4-2, the sound arising from the reproduction sound signal reproduced by the speaker 8 and is digitized by the analog/digital converter 5-2 will be referred to as a second echo signal.

The analog/digital converter 5-1 outputs the first echo signal to the echo suppression device 61. Similarly, the analog/digital converter 5-2 outputs the second echo signal to the echo suppression device 61.

Figure 9:
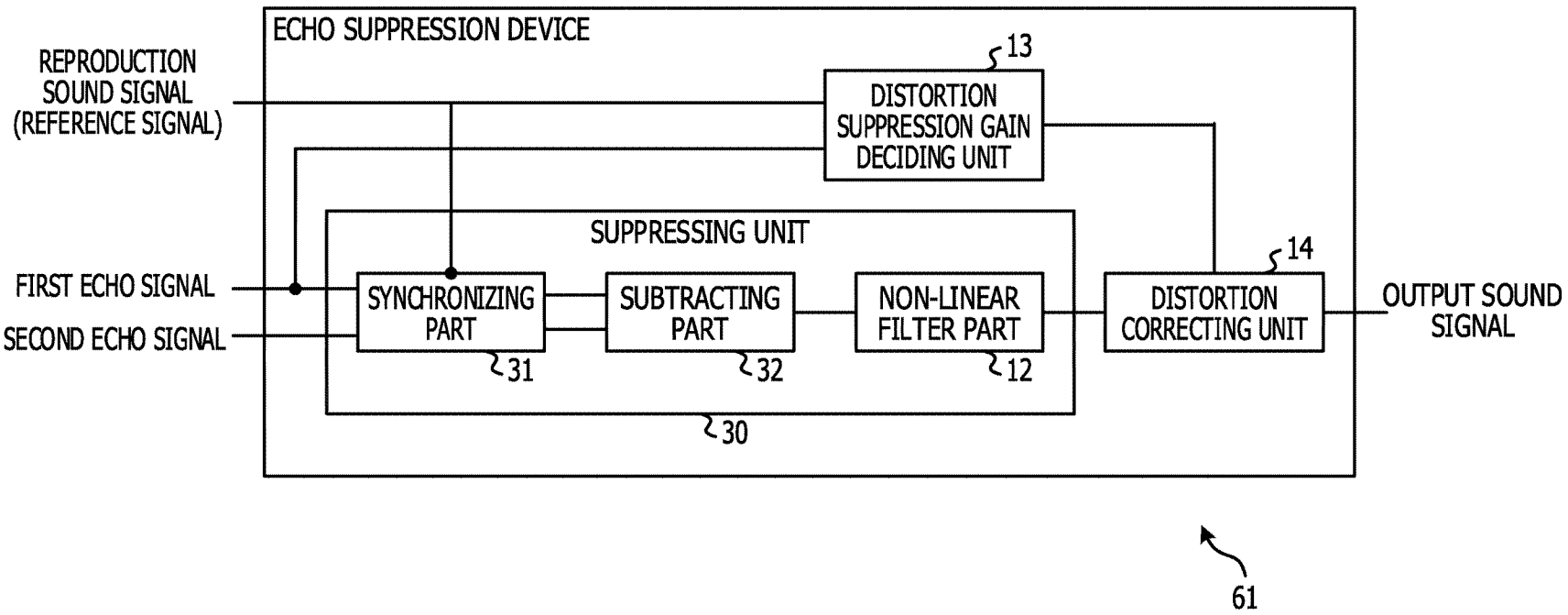
FIG. 9 is a schematic configuration diagram of an echo suppression device according to the second embodiment.

FIG. 9 is a schematic configuration diagram of an echo suppression device according to the second embodiment. The echo suppression device depicted in FIG. 9 may be the echo suppression device 61 depicted in FIG. 8. The echo suppression device 61 includes a suppressing unit 30, the distortion suppression gain deciding unit 13, and the distortion correcting unit 14. Furthermore, the suppressing unit 30 includes a synchronizing part 31, a subtracting part 32, and the non-linear filter part 12.

These respective units possessed by the echo suppression device 61 may be each implemented in the echo suppression device 61 as a separate circuit or may be one integrated circuit that implements the functions of these respective units. Compared with the echo suppression device 6 according to the first embodiment, the echo suppression device 61 according to the second embodiment is different in that the suppressing unit 30 includes the synchronizing part 31 and the subtracting part 32 instead of the linear filter part 11. Therefore, in the following, the synchronizing part 31, the subtracting part 32, and a related part will be described. Regarding the other constituent elements in the echo suppression device 61, refer to the description of the corresponding constituent elements in the echo suppression device 6.

The synchronizing part 31 synchronizes the first echo signal and the second echo signal. For implementing the synchronization, the synchronizing part 31 calculates the cross-correlation value between the first echo signal and a reference signal with variation in the delay time of the first echo signal relative to the reference signal, and identifies the delay time with which the cross-correlation value becomes the maximum as a first delay time. Similarly, the synchronizing part 31 calculates the cross-correlation value between the second echo signal and the reference signal with variation in the delay time of the second echo signal relative to the reference signal, and identifies the delay time with which the cross-correlation value becomes the maximum as a second delay time. Then, the synchronizing part 31 delays the first echo signal by (the second delay time−the first delay time) for example (when the second delay time>the first delay time). Or, the synchronizing part 31 delays the second echo signal by (the first delay time−the second delay time) (when the first delay time>the second delay time). Due to the delays, the delays of the first echo signal and the second echo signal from the reference signal both become the first delay time or the second delay time. Thus, the synchronizing part 31 may synchronize the first echo signal and the second echo signal with respect to the reference signal.

The synchronizing part 31 outputs the synchronized first echo signal and second echo signal to the subtracting part 32.

The subtracting part 32 calculates the difference between the synchronized first echo signal and second echo signal as a residual signal. The residual signal has a very small value if non-linear distortion is caused in neither the first echo signal nor the second echo signal. On the other hand, if non-linear distortion is caused in either the first echo signal or the second echo signal, the residual signal has a certain level of power.

The subtracting part 32 outputs the residual signal to the non-linear filter part 12.

The non-linear filter part 12 executes, for the residual signal, the same processing as the processing by the non-linear filter part 12 according to the first embodiment to suppress an echo component included in the residual signal and calculate a corrected residual signal. Then, the non-linear filter part 12 outputs the corrected residual signal to the distortion correcting unit 14. The corrected residual signal is one example of the corrected sound signal.

Similarly to the distortion suppression gain deciding unit 13 according to the first embodiment, the distortion suppression gain deciding unit 13 calculates a gain in such a manner that the gain is lower when the possibility that non-linear distortion is caused in the first echo signal or the second echo signal is higher. For this purpose, the distortion suppression gain deciding unit 13 decides the gain on the basis of the power of the reference signal and the absolute value of the cross-correlation value between the reference signal and the first echo signal or the second echo signal similarly to the distortion suppression gain deciding unit 13 according to the first embodiment. In the present embodiment, the distortion suppression gain deciding unit 13 may use either signal of the first echo signal and the second echo signal for the calculation of the absolute value of the cross-correlation value.

According to the second embodiment, the echo suppression device 61 may suppress the echo signal more sufficiently because the echo suppression device 61 utilizes the difference between echo signals generated by each of the plural microphones.

According to another modification example, the distortion suppression gain deciding unit 13 may use only power of a reference signal as an index for estimating a degree of non-linear distortion of an echo signal.

Figure 10:
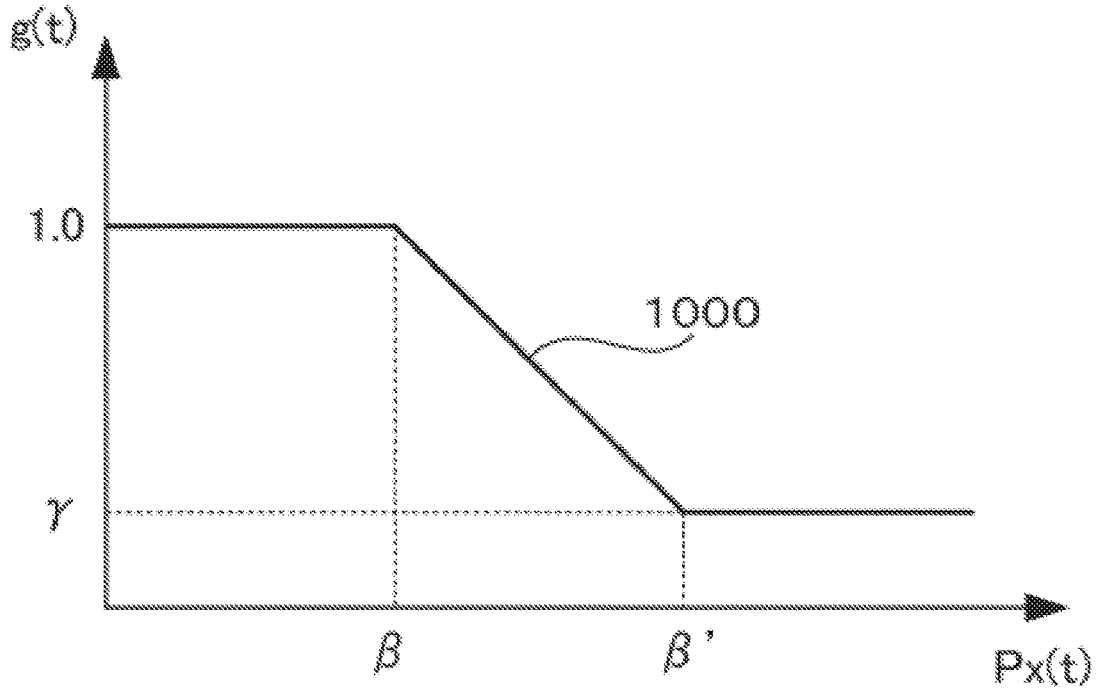
FIG. 10 is a diagram illustrating a relationship between power of a reference signal and a gain according to a modification example.

FIG. 10 is a diagram illustrating a relationship between power of a reference signal and a gain according to a modification example. In FIG. 10, the abscissa axis represents power Px(t) and the ordinate axis represents a gain g(t). Furthermore, a graph 1000 represents the relationship between the power Px(t) and the gain g(t). As illustrated in the graph 1000, when the power Px(t) is lower than a threshold β, the gain g(t) is set to 1.0. That is, the corrected residual echo signal is not suppressed. On the other hand, when the power Px(t) is equal to or higher than an upper-limit threshold β', the gain g(t) is set to a lower-limit value γ thereof. Furthermore, when the power Px(t) is equal to or higher than the threshold β and is lower than the upper-limit threshold β', the gain g(t) monotonically decreases linearly as the power Px(t) becomes higher. In this case, the threshold β may be set to the lower-limit value of the power over which the device relating to input and output of sounds, such as the microphone or the speaker, exhibits non-linearity. The upper-limit threshold β' may be set to 2β for example. The lower-limit value γ of the gain g(t) is set to 0.01 to 0.1 for example.

According to further another modification example, the non-linear filter part 12 may be omitted. In this case, the distortion correcting unit 14 may multiply a residual echo signal or a residual signal by a gain calculated by the distortion suppression gain deciding unit 13. Alternatively, the distortion correcting unit 14 may use a value derived by multiplying the gain calculated by the distortion suppression gain deciding unit 13 and a gain obtained by executing the same processing as the processing by the non-linear filter part 12 as a gain by which a corrected residual echo signal or a corrected residual signal is multiplied.

According to further another modification example, the distortion suppression gain deciding unit 13 may obtain a gain as a coefficient to attenuate the amplitude component of a frequency signal obtained by performing a time-frequency transform of a corrected residual echo signal or a corrected residual signal. In this case, the distortion correcting unit 14 obtains the frequency signal by performing the time-frequency transform of the corrected residual echo signal or the corrected residual signal in units of frame, and corrects the frequency signal by multiplying the amplitude component of the frequency signal by the gain. Thereafter, the distortion correcting unit 14 obtains an output sound signal by performing a frequency-time transform of the corrected frequency signal.

The echo suppression devices according to the above-described respective embodiments or the modification examples thereof may be implemented in various devices that may be coupled to a microphone and a speaker, such as various kinds of audio equipment and personal computers.

A computer program that causes a computer to implement the respective functions possessed by the respective units of the echo suppression devices according to the above-described respective embodiments or the modification examples thereof may be provided in a form of being recorded in a computer-readable medium such as a magnetic recording medium or an optical recording medium.

Figure 11:
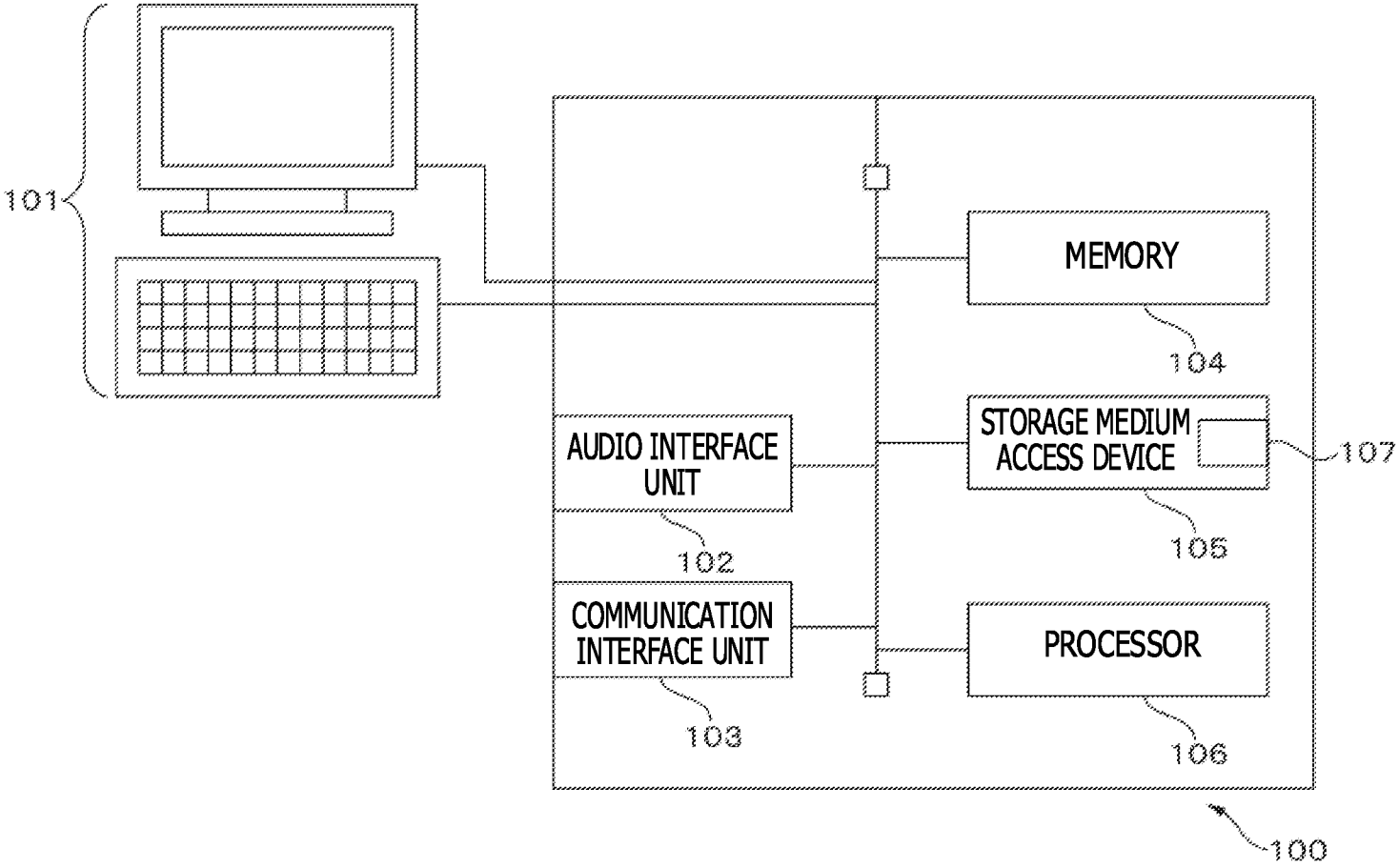
FIG. 11 is a configuration diagram of a computer that operates as an echo suppression device according to respective embodiments or a modification example thereof by operation of a computer program that implements functions of respective units in the echo suppression device.

FIG. 11 is a configuration diagram of a computer that operates as an echo suppression device according to the above-described embodiments or a modification example thereof by operation of a computer program that implements functions of respective units of the echo suppression device.

A computer 100 includes a user interface unit 101, an audio interface unit 102, a communication interface unit 103, a storage unit 104, a storage medium access device 105, and a processor 106. The processor 106 is coupled to the user interface unit 101, the audio interface unit 102, the communication interface unit 103, the storage unit 104, and the storage medium access device 105 via a bus for example.

The user interface unit 101 includes an input device such as a keyboard and a mouse and a display device such as a liquid crystal display for example. Alternatively, the user interface unit 101 may include a device obtained by integrating an input device and a display device, such as a touch panel display. Furthermore, the user interface unit 101 outputs an operation signal to initiate echo suppression processing to the processor 106 according to operation by a user for example.

The audio interface unit 102 includes an interface circuit for coupling the computer 100 to a microphone and a speaker (not illustrated). Furthermore, the audio interface unit 102 outputs a reproduction sound signal received from the processor 106 to the speaker. Alternatively, the audio interface unit 102 transfers an input sound signal received from the microphone to the processor 106.

The communication interface unit 103 includes a communication interface for coupling to a communication network that complies with a communication standard such as the Ethernet (registered trademark) and a control circuit of the communication interface. Furthermore, the communication interface unit 103 acquires a packet including a reproduction sound signal from another piece of equipment coupled to the communication network and transfers the packet to the processor 106. In addition, the communication interface unit 103 may output a packet that is received from the processor 106 and includes a sound signal in which an echo is suppressed to the other piece of equipment via the communication network.

The storage unit 104 includes a readable and writable semiconductor memory and a read-only semiconductor memory for example. Furthermore, the storage unit 104 stores a computer program that is executed on the processor 106 and is for executing sound processing and various data used in the sound processing.

The storage medium access device 105 is a device that accesses a storage medium 107 such as a magnetic disc, a semiconductor memory card, and an optical storage medium for example. The storage medium access device 105 reads a computer program for echo suppression that is stored in the storage medium 107 and is executed on the processor 106 and transfers the computer program to the processor 106 for example.

The processor 106 suppresses an echo signal received from the microphone by executing the computer program for echo suppression according to any of the above-described respective embodiments or the modification example. Then, the processor 106 outputs the suppressed echo signal to the communication interface unit 103.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An echo suppression device comprising:

a memory; and a processor coupled to the memory, the processor configured to cause the following to be performed:

generating a corrected sound signal by suppressing an echo signal representing an echo generated by collecting, by a sound input unit, a sound arising from a reproduction sound signal reproduced by a sound output unit;

deciding a gain to attenuate the corrected sound signal, the gain being decided based on a degree of distortion of the echo signal to the reproduction sound signal, the distortion being non-linearly changes of intensity arising according to an intensity change of the reproduction sound signal; and suppressing the corrected sound signal according to the gain.

2. The device according to claim 1, wherein the deciding calculates power of the reproduction sound signal and a correlation value between the reproduction sound signal and the echo signal as indices representing the degree of distortion, and decides the gain according to the power of the reproduction sound signal and the correlation value.

3. The device according to claim 2, wherein the deciding decides the gain in such a manner that a degree of attenuation of the corrected sound signal is higher when the power of the reproduction sound signal is higher and when an absolute value of the correlation value is smaller.

4. The device according to claim 3, wherein the deciding sets, to a larger value, an upper-limit value of the absolute value of the correlation value under which the corrected sound signal is attenuated when the power of the reproduction sound signal is higher, and decides the gain in such a manner that the degree of attenuation of the corrected sound signal is higher when the absolute value of the correlation value is smaller than the upper-limit value and difference between the upper-limit value and the absolute value of the correlation value is larger.

5. The device according to claim 1, wherein the deciding calculates power of the reproduction sound signal as an index representing the degree of distortion and decides the gain according to the power.

6. The device according to claim 5, wherein the deciding decides the gain in such a manner that a degree of attenuation of the corrected sound signal is higher when the power is higher than a given threshold and difference between the power and the given threshold is larger.

7. The device according to claim 1, wherein the generating synchronizes the echo signal and a second echo signal generated by collecting the sound arising from the reproduction sound signal reproduced by the sound output unit by a second sound input unit disposed at a different position from the sound input unit, and obtains the corrected sound signal according to difference between the echo signal and the second echo signal that are synchronized.

8. An echo suppression method comprising:

generating a corrected sound signal by suppressing an echo signal representing an echo generated by collecting, by a sound input unit, a sound arising from a reproduction sound signal reproduced by a sound output unit;

deciding, by a computer processor, a gain to attenuate the corrected sound signal, the gain being decided based on a degree of distortion of the echo signal to the reproduction sound signal, the distortion being non-linearly changes of intensity arising according to an intensity change of the reproduction sound signal; and suppressing the corrected sound signal according to the gain.

9. The method according to claim 8, wherein the deciding calculates power of the reproduction sound signal and a correlation value between the reproduction sound signal and the echo signal as indices representing the degree of distortion, and decides the gain according to the power of the reproduction sound signal and the correlation value.

10. The method according to claim 9, wherein the deciding decides the gain in such a manner that a degree of attenuation of the corrected sound signal is higher when the power of the reproduction sound signal is higher and when an absolute value of the correlation value is smaller.

11. The method according to claim 10, wherein the deciding sets, to a larger value, an upper-limit value of the absolute value of the correlation value under which the corrected sound signal is attenuated when the power of the reproduction sound signal is higher, and decides the gain in such a manner that the degree of attenuation of the corrected sound signal is higher when the absolute value of the correlation value is smaller than the upper-limit value and difference between the upper-limit value and the absolute value of the correlation value is larger.

12. The method according to claim 8, wherein the deciding calculates power of the reproduction sound signal as an index representing the degree of distortion and decides the gain according to the power.

13. The method according to claim 12, wherein the deciding decides the gain in such a manner that a degree of attenuation of the corrected sound signal is higher when the power is higher than a given threshold and difference between the power and the given threshold is larger.

14. The method according to claim 8, wherein the generating synchronizes the echo signal and a second echo signal generated by collecting the sound arising from the reproduction sound signal reproduced by the sound output unit by a second sound input unit disposed at a different position from the sound input unit, and obtains the corrected sound signal according to difference between the echo signal and the second echo signal that are synchronized.

15. A non-transitory computer-readable medium that stores an echo suppression program for causing a computer to execute a process comprising:

generating a corrected sound signal by suppressing an echo signal representing an echo generated by collecting, by a sound input unit, a sound arising from a reproduction sound signal reproduced by a sound output unit;

deciding a gain to attenuate the corrected sound signal, the gain being decided based on a degree of distortion of the echo signal to the reproduction sound signal, the distortion being non-linearly changes of intensity arising according to an intensity change of the reproduction sound signal; and suppressing the corrected sound signal according to the gain.

* * * * *